US005928486A

United States Patent [19]

Castegnier et al.

[11] Patent Number: 5,928,486

[45] Date of Patent: Jul. 27, 1999

[54] IMAGE REVEALING SQUEEGEE DEVICE FOR AN ELECTROCOAGULATION PRINTING APPARATUS

[75] Inventors: Adrien Castegnier, Outremont; Normand Davidson, Val-David; Gilles Gadbois, Rawdon; Christian Laplante, Chateauguay, all of Canada

[73] Assignee: Elcorsy Technology Inc., Saint-Laurent, Canada

[21] Appl. No.: 08/997,356

[22] Filed: Dec. 23, 1997

[51] Int. Cl.[6] ..... C25D 13/00

[52] U.S. Cl. ..... 204/623; 101/DIG. 29; 101/DIG. 37

[58] Field of Search ..... 204/623; 101/DIG. 37, 101/DIG. 29

[56] References Cited

U.S. PATENT DOCUMENTS 4,895,629 1/1990 Castegnier ..... 204/180.9
5,693,206 12/1997 Castegnier et al. ..... 204/623

*Primary Examiner*—Kishor Mayekar
*Attorney, Agent, or Firm*—Swabey Ogilvy Renault

[57] ABSTRACT

An image revealing squeegee device for an electrocoagulation printing apparatus including a positive cylindrical electrode having a central longitudinal axis and a passivated surface on which dots of colored, coagulated colloid representative of a desired image are formed by electrocoagulation of an electrolytically coagulable colloid present in a colloidal dispersion containing a coloring agent, the positive electrode having a predetermined radius and being rotatable about the longitudinal axis in a predetermined direction. The squeegee device of the invention comprises an elongated blade member of resilient material having two planar surfaces intersecting one another to define a rectilinear edge extending parallel to the longitudinal axis of the positive electrode and adapted to contact the surface thereof, one of the planar surfaces defining a colloid arresting surface for retaining upstream of the blade member excess colloidal dispersion carried by the positive electrode and containing non-coagulated colloid, the colloid arresting surface being inclined in a direction opposite to the direction of rotation of the electrode at an angle of about 100° to about 160° relative to the radius thereof, and means for holding the blade member in pressure contact engagement with the positive electrode. Upon rotation of the positive electrode, non-coagulated colloid contained in the dispersion is retained by the colloid arresting surface, thereby uncovering the dots of colored, coagulated colloid without adversely affecting the coagulated colloid.

21 Claims, 3 Drawing Sheets

IMAGE REVEALING SQUEEGEE DEVICE FOR AN ELECTROCOAGULATION PRINTING APPARATUS

The present invention pertains to improvements in the field of electrocoagulation printing. More particularly, the invention relates to an image revealing squeegee device for an electrocoagulation printing apparatus.

BACKGROUND OF THE INVENTION

In U.S. Pat. No. 4,895,629 of Jan. 23, 1990, Applicant has described a high-speed electrocoagulation printing method and apparatus in which use is made of a positive electrode in the form of a revolving cylinder having a passivated surface onto which dots of colored, coagulated colloid representative of an image are produced. These dots of colored, coagulated colloid are thereafter contacted with a substrate such as paper to cause transfer of the colored, coagulated colloid onto the substrate and thereby imprint the substrate with the image. As explained in this patent, the surface of the positive electrode is coated with a dispersion containing an olefinic substance and a metal oxide prior to electrical energization of the negative electrodes in order to weaken the adherence of the dots of coagulated colloid to the positive electrode and also to prevent an uncontrolled corrosion of the positive electrode. In addition, gas generated as a result of electrolysis upon energizing the negative electrodes is consumed by reaction with the olefinic substance so that there is no gas accumulation between the negative and positive electrodes.

The electrocoagulation printing ink which is injected into the gap defined between the positive and negative electrodes consists essentially of a liquid colloidal dispersion containing an electrolytically coagulable colloid, a dispersing medium, a soluble electrolyte and a coloring agent. Where the coloring agent used is a pigment, a dispersing agent is added for uniformly dispersing the pigment into the ink. After coagulation of the colloid, any remaining non-coagulated colloid is removed from the surface of the positive electrode, for example, by scraping the surface with a soft rubber squeegee, so as to fully uncover the colored, coagulated colloid which is thereafter transferred onto the substrate. The surface of the positive electrode is then cleaned to remove therefrom any remaining coagulated colloid.

The rubber squeegee which is used to remove any remaining non-coagulated colloid from the surface of the positive electrode comprises an elongated blade member having a generally triangular cross-section with a longitudinal axis extending parallel to the rotation axis of the positive electrode and a transverse axis which inclined in a direction opposite to the direction of rotation of the electrode at an angle of about 5° relative to the radius thereof. Applicant has observed that it is necessary to apply with such a squeegee a linear loading of about 17 N/cm onto the surface of the electrode in order to completely remove therefrom all non-coagulated colloid. Such a high linear loading, however, causes an abrasion of the dots of colored, coagulated colloid formed on the surface of the electrode so that the coagulated colloid is no longer representative of the desired image. The same problem has also been encountered with the squeegee device described in Applicant's copending U.S. application Ser. No. 08/665,458.

SUMMARY OF THE INVENTION

It is therefore an object of the present invention to overcome the above drawback and to provide an image revealing squeegee device which is capable of adequately removing any non-coagulated colloid remaining on the surface of the positive electrode of an electrocoagulation printing apparatus, without adversely affecting the coagulated colloid.

According to one aspect of the invention, there is provided an image revealing squeegee device for an electrocoagulation printing apparatus including a positive cylindrical electrode having a central longitudinal axis and a passivated surface on which dots of colored, coagulated colloid representative of a desired image are formed by electrocoagulation of an electrolytically coagulable colloid present in a colloidal dispersion containing a coloring agent, the positive electrode having a predetermined radius and being rotatable about the longitudinal axis in a predetermined direction. The squeegee device of the invention comprises an elongated blade member of resilient material having two planar surfaces intersecting one another to define a rectilinear edge extending parallel to the longitudinal axis of the positive electrode and adapted to contact the surface thereof, one of the planar surfaces defining a colloid arresting surface for retaining upstream of the blade member excess colloidal dispersion carried by the positive electrode and containing non-coagulated colloid, the colloid arresting surface being inclined in a direction opposite to the direction of rotation of the electrode at an angle of about 100° to about 160° relative to the radius thereof, and means for holding the blade member in pressure contact engagement with the positive electrode. Upon rotation of the positive electrode, non-coagulated colloid contained in the dispersion is retained by the colloid arresting surface, thereby uncovering the dots of colored, coagulated colloid without adversely affecting the coagulated colloid.

According to another aspect of the invention, there is also provided in an electrocoagulation printing apparatus including a positive cylindrical electrode having a central longitudinal axis and a passivated surface on which dots of colored, coagulated colloid representative of a desired image are formed by electrocoagulation of an electrolytically coagulable colloid present in a colloidal dispersion containing a coloring agent, the positive electrode having a predetermined radius and being rotatable about the longitudinal axis in a predetermined direction, and an image revealing squeegee device for removing any remaining non-coagulated colloid from the surface of the positive electrode, the improvement wherein the squeegee device is as defined above.

Applicant has found quite unexpectedly that by using a blade member having two planar surfaces intersecting one another to define a rectilinear edge extending parallel to the longitudinal axis of the positive electrode and in pressure contact engagement with the surface thereof, one of the planar surfaces defining a colloid arresting surface which is inclined in a direction opposite to the direction of rotation of the electrode at an angle of about 100° to about 160° relative to the radius thereof, one can apply with such a blade member a linear loading as low as 2.5 N/cm onto the surface of the electrode so that there is substantially no abrasion of the dots of colored, coagulated colloid, while adequately removing all non-coagulated colloid. A blade member having a colloid arresting surface which is inclined at an angle greater than 160° relative to the radius of the electrode causes abrasion of the dots of colored, coagulated colloid. On the other hand, a blade member having a colloid arresting surface which is inclined at an angle less than 100° does not completely remove the non-coagulated colloid remaining on the surface of the electrode.

According to a preferred embodiment of the invention, the positive electrode is mounted between opposite first and second electrode-supporting members, and the means for holding the blade member comprises an elongated blade-supporting member connected to and extending longitudinally of the blade member so as to maintain the colloid arresting surface inclined at the aforesaid angle, the blade-supporting member being mounted between opposite first and second support members adapted for connection respectively to the first and second electrode-supporting members. Preferably, the colloid arresting surface is inclined at an angle of about 140° relative to the radius of the positive electrode.

According to another preferred embodiment, the squeegee device further includes angle adjustment means for adjustably varying the angle defined between the colloid arresting surface and the radius of the positive electrode. Preferably, first and second attachment members are arranged between each end of the blade-supporting member and a respective one of the first and second support members with each first attachment member being fixed to a respective end of the blade-supporting member and each second attachment member being mounted to the respective support member. The angle adjustment means comprises means for adjustably connecting each first attachment member to a respective second attachment member so as to permit the blade member to adjustably move about a pivot axis coincident with the rectilinear edge, thereby varying the angle defined between the colloid arresting surface and the radius.

According to yet another preferred embodiment, the squeegee device further includes pressure adjustment means for adjustably varying the pressure exerted between the blade member and the surface of the positive electrode. Preferably, each second attachment member is displaceably mounted to the respective support member for movement in a direction towards or away from the positive electrode. The pressure adjustment means comprises means for adjustably moving each second attachment member and the first attachment member connected thereto towards or away from the positive electrode to thereby vary the pressure exerted by the blade member against the surface of the positive electrode.

According to a further preferred embodiment, the first and second support members are adapted for pivotal connection respectively to the first and second electrode-supporting members for movement about a pivot axis extending parallel to the longitudinal axis of the positive electrode to thereby permit the blade member to move between a working position whereat the blade member is in aforesaid engagement with the surface of the electrode and a non-working position whereat the blade member is disengaged from the surface, releasable locking means releasably securing the first and second support members respectively to the first and second electrode-supporting members when the blade member is in the working position.

Preferably, the blade member has a generally rectangular cross-section and is removably fixed to the support member. Thus, when the aforesaid edge which is pressure contact engagement with the surface of positive electrode has worn down, the blade member can be repositioned on the support member so that the other rectilinear edge which is defined by the colloid arresting surface and is opposite to the worn edge contacts the surface of the electrode.

The blade member is advantageously made of synthetic rubber material which is resistant to attack by oil so as to prevent the blade member from undergoing degradation in the pressure of the olefinic substance used for coating the surface of the positive electrode. For example, use can be made of a polyurethane having a Shore A hardness of about 25 to about 60, preferably about 45.

The image revealing squeegee device according to the invention enables one to adequately remove any non-coagulated colloid remaining on the surface of the positive electrode of an electrocoagulation printing apparatus, without adversely affecting the coagulated colloid.

BRIEF DESCRIPTION OF THE DRAWINGS

Further features and advantages of the invention will become more readily apparent from the following description of preferred embodiments as illustrated by way of examples in the accompanying drawings, in which.

DESCRIPTION OF PREFERRED EMBODIMENTS

Figure 1:
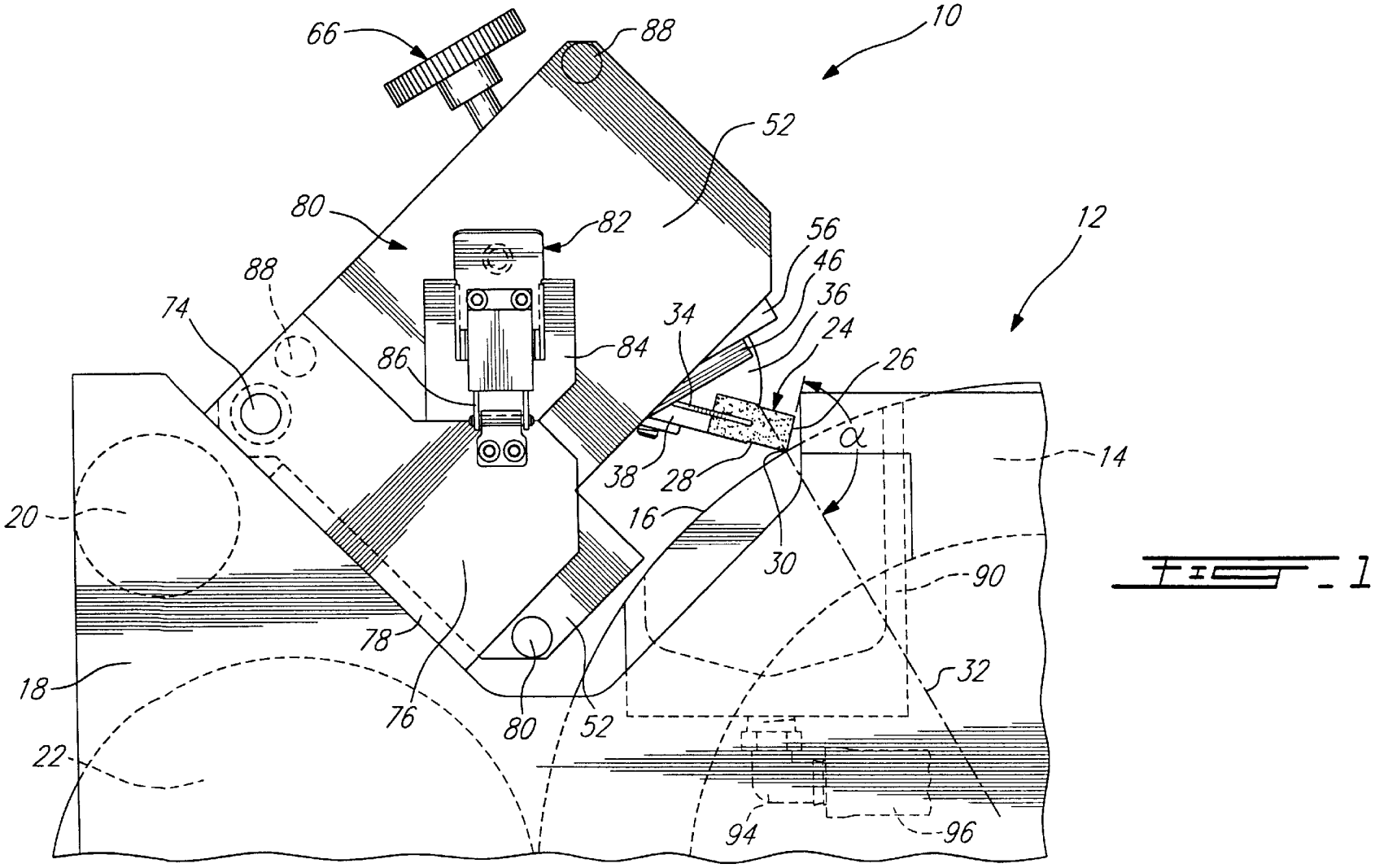
FIG. 1 is a fragmentary side elevational view illustrating an image revealing squeegee device according to preferred embodiment of the invention, shown installed on an electrocoagulation printing apparatus.

Referring first to FIG. 1, there is illustrated an image revealing squeegee device which is generally designated by reference numeral 10 and shown installed on an electrocoagulation printing apparatus 12. The apparatus 12 includes a positive electrode 14 in the form of a revolving cylinder and having a passivated surface 16 on which dots of colored, coagulated colloid representative of a desired image are formed by electrocoagulation of an electrolytically coagulable colloid present in a colloidal dispersion containing a coloring agent. The cylindrical electrode 14 is rotatably mounted between a pair of opposite vertical plates 18, 18' (plate member 18' being shown in FIG. 2), for rotation about its longitudinal axis in a counter-clockwise direction. A plurality of cylindrical brace members 20 (only one shown) interconnect the plates 18 and 18'. The apparatus 12 further includes a pressure roller 22 for bringing a paper web (not shown) into contact with the dots of colored, coagulated colloid to cause transfer of the colored, coagulated colloid onto the web and thereby imprint the web with the image.

Figure 2:
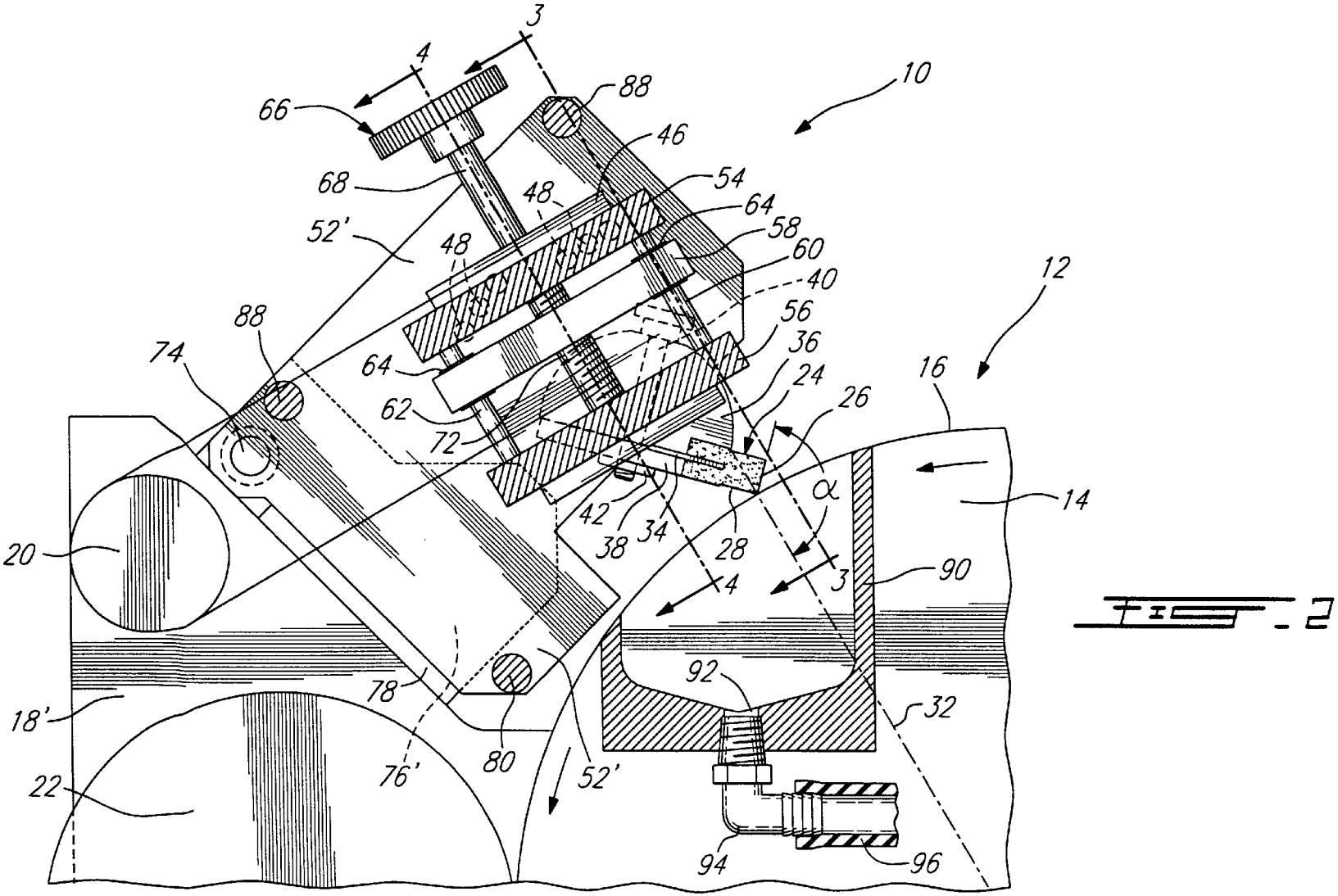
FIG. 2 is a sectional view taken along line 2—2 of FIG. 3.
Figures 3, 4:
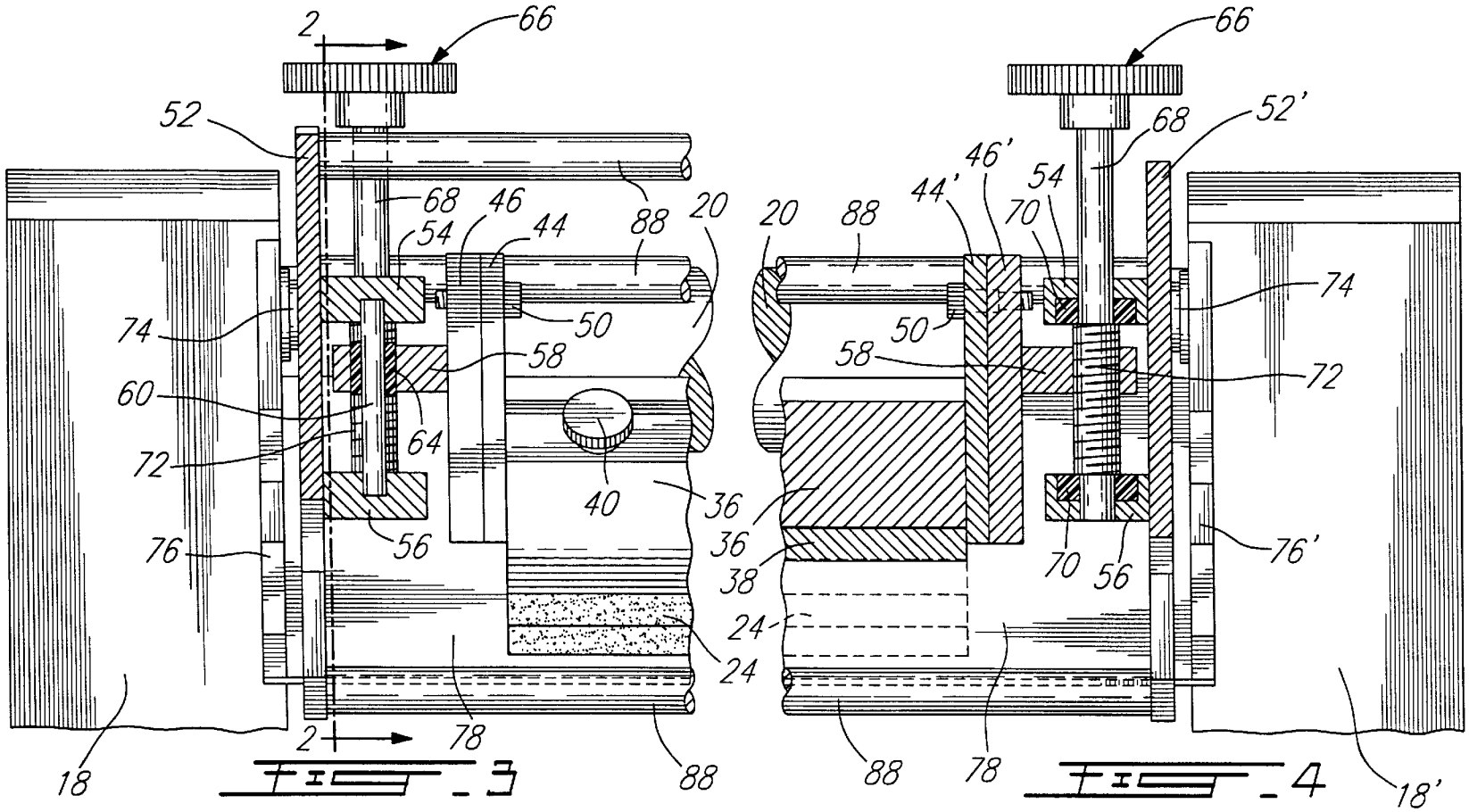
FIG. 3 is a section view taken along line 3—3 of FIG. 2.
FIG. 4 is a sectional view taken along line 4—4 of FIG. 2.

The squeegee device 10 is adapted to remove from the electrode surface 16 excess colloidal dispersion containing non-coagulated colloid and carried by the electrode 14 during rotation thereof. As shown in FIGS. 2–4, the device 10 comprises an elongated blade member 24 made of a resilient material and having a rectangular cross-section with two planar surfaces 26, 28 intersecting one another to define a rectilinear edge 30 extending parallel to the longitudinal axis of the electrode 14 and contacting the surface 16 thereof. The surface 26 defines a colloid arresting surface for retaining upstream of the blade member 24 excess colloidal dispersion carried by the electrode 14 and containing non-coagulated colloid. Such a surface is inclined in a direction opposite to the direction of rotation of the electrode 14 at an angle $\alpha$ of about 140° relative to the radius 32 thereof.

An elongated blade reinforcing member 34 of rectangular cross-section partially extends in tight fit engagement into an elongated, longitudinally extending recess formed in the blade member 24. The blade member 24 is removably fixed to an elongated support member 36 by means of a clamping plate 38 and a plurality of screws 40 and nuts 42 (only one of each shown) which releasably retain the portion of the blade reinforcing member 34 projecting outwardly from the blade member 24 clamped against the support member 36. The support member 36 is mounted between a pair of planar attachment members 44, 44' which are adjustably connected respectively to further planar attachment members 46, 46' so as to permit the blade member 24 to adjustably move about a pivot axis coincident with the rectilinear edge 30 and thereby vary the angle α. The attachment members 46, 46' are each provided with two series of spaced-apart apertures 48 positioned along predetermined arcs of circle. The attachment members 44, 44', on the other hand, are each provided with a removable screw 50 threadedly engaged in a selected one of the apertures 48 to releasably fasten the members 44, 46 and 44', 46' together and adjustably position the blade member 24 so that the surface 26 is inclined at a selected angle α.

The attachment members 46 and 46' are displaceably mounted to opposite plates 52 and 52', respectively, for movement in a direction towards or away from the electrode 14. The attachment members 46, 46' are each provided with two brackets 54 and 56 arranged in spaced-apart, opposed relation to one another. The plates 52, 52', on the other hand, are each provided with a bracket 58 extending between the brackets 54 and 56. Each bracket 58 is displaceably mounted between the brackets 54 and 56 by means of two guide rods 60, 62 interconnecting the brackets 54 and 56 and extending through bushings 64 arranged in the bracket 58. Two adjustable screw members 66 each having a stem 68 extending through bushings 70 in the brackets 54, 56 and a threaded stem portion threadedly engaged with the bracket 58 are provided for adjustably moving the brackets 58 and the attachment members 46, 46' fixed thereto towards or away from the electrode 14. Since the blade member 24, support member 34 and attachment members 44, 44' and 46, 46' are fixedly connected together, movement of the attachment members 46, 46' will cause a variation of the pressure exerted by the blade member 24 against the surface 16 of the electrode 14. Thus, by adjustably rotating the screw members 66, one can adjustably vary the pressure exerted between the blade member 24 and the electrode surface 16.

The plates 52, 52' are pivotally connected by pivot pins 74 respectively to support plates 76, 76' fixed to the plates 18, 18', respectively, for pivotal movement of the device 10 in a direction towards or away from the electrode 14, between the working position illustrated in FIG. 1, whereat the blade member 24 is in pressure contact engagement with the surface 16 of the electrode 14, and a non-working position (not shown) whereat the blade member 24 is disengaged from the electrode surface 16. In the working position, the plates 52, 52' abut against an elongated abutment plate 78 which is fixed to the support plates 76, 76'. Two releasable locking devices 80 (only one shown) comprising a strike and catch mechanism are provided for releasably securing the plates 52 and 52' to the support plates 76 and 76', respectively, when the device is in the working position. The strike members 82 (only one shown) are fixedly mounted to spacers 84 (only one shown) fixed to the plates 52, 52', whereas the catch members 86 (only one shown) are fixedly mounted to the support plates 76, 76'. A plurality of cylindrical brace members 88 interconnect the plates 52 and 52'.

A top-opened container 90 is disposed at each end of the electrode 14 adjacent the blade member 24 for collecting excess colloidal dispersion retained by the blade member 24 and overflowing from the surface 16 of the electrode 14 at the ends thereof. Each container 90 is provided a bottom opening 92 connected by an elbow pipe 94 and tubing 96 to a recirculation pump (not shown) for recirculating the excess colloidal dispersion to the colloid injection (not shown) of the apparatus 12.

We claim:

1. In an electrocoagulation printing apparatus including a positive cylindrical electrode having a central longitudinal axis and a passivated surface on which dots of colored, coagulated colloid representative of a desired image are formed by electrocoagulation of an electrolytically coagulable colloid present in a colloidal dispersion containing a coloring agent, said positive electrode having a selected radius and being rotatable about the longitudinal axis in a selected direction, and an image revealing squeegee device for removing any remaining non-coagulated colloid from the surface of said positive electrode, the improvement wherein said squeegee device comprises:

an elongated blade member of resilient material having two planar surfaces intersecting one another to define a rectilinear edge extending parallel to the longitudinal axis of said positive electrode and adapted to contact the surface thereof, one of said planar surfaces defining a colloid arresting surface for retaining upstream of said blade member excess colloidal dispersion carried by said positive electrode and containing non-coagulated colloid, said colloid arresting surface being inclined in a direction opposite to the direction of rotation of said electrode at an angle of about 100° to about 160° relative to the radius thereof; and means for holding said blade member in pressure contact engagement with said positive electrode; so that upon rotation of said positive electrode, non-coagulated colloid contained in said dispersion is retained by said colloid arresting surface, and the dots of colored, coagulated colloid are uncovered without the coagulated colloid being adversely affected.

2. An apparatus as claimed in claim 1, wherein said colloid arresting surface is inclined at an angle of about 140° relative to the radius of said positive electrode.

3. An apparatus as claimed in claim 1, wherein said positive electrode is mounted between opposite first and second electrode-supporting members, and wherein said means for holding said blade member comprises an elongated blade-supporting member connected to and extending longitudinally of said blade member to maintain said colloid arresting surface inclined at said angle, said blade-supporting member being mounted between opposite first and second support members connected respectively to said first and second electrode-supporting members.

4. An apparatus as claimed in claim 3, wherein said squeegee device further includes angle adjustment means for adjustably varying the angle defined between said colloid arresting surface and said radius.

5. An apparatus as claimed in claim 4, wherein first and second attachment members are arranged between each end of said blade-supporting member and a respective one of said first and second support members with each first attachment member being fixed to a respective end of said blade-supporting member and each second attachment member being mounted to said respective support member, and wherein said angle adjustment means comprises means for adjustably connecting each first attachment member to a respective second attachment member to permit said blade member to adjustably move about a pivot axis coincident with said rectilinear edge, and vary the angle defined between said colloid arresting surface and said radius.

6. An apparatus as claimed in claim 5, wherein each said second attachment member is provided with at least one series of spaced-apart apertures positioned along a selected arc of circle and wherein each said first attachment member is provided with releasable fastener means engaged in a selected one of said apertures to releasably fasten said first and second attachment members together and adjustably position said blade member so that said colloid arresting surface is inclined at a selected angle relative to said radius, said apertures and fastener means defining said angle adjustment means.

7. An apparatus as claimed in claim 5, wherein said first and second attachment members are each planar members lying in a respective plane extending transversely of said support member.

8. An apparatus as claimed in claim 5, wherein said squeegee device further includes pressure adjustment means for adjustably varying the pressure exerted between said blade member and the surface of said positive electrode.

9. An apparatus as claimed in claim 8, wherein each said second attachment member is displaceably mounted to said respective support member for movement in a direction towards or away from said positive electrode, and wherein said pressure adjustment means comprises means for adjustably moving each said second attachment member and said first attachment member connected thereto towards or away from said positive electrode to vary the pressure exerted by said blade member against the surface of said positive electrode.

10. An apparatus as claimed in claim 9, wherein said first and second support members are each provided first and second brackets arranged in spaced-apart, opposed relation to one another and a third bracket is fixed to each said second attachment member, said third bracket being displaceably mounted between said first and second brackets for movement in a direction towards or away from said positive electrode, and wherein said means for adjustably moving each said second attachment member and said first attachment connected thereto towards or away from said positive electrode comprises adjustable screw means associated with each said third bracket in threaded engagement therewith and connected to said first and second brackets.

11. An apparatus as claimed in claim 10, wherein a pair of guide rods are associated with each said third bracket and extend between said first and second brackets, and wherein each said third bracket is slidably mounted to the associated guide rods for movement in a direction towards or away from said positive electrode.

12. An apparatus as claimed in claim 3, wherein said first and second support members are pivotally connected respectively to said first and second electrode-supporting members for pivotal movement about a pivot axis extending parallel to the longitudinal axis of said positive electrode to permit said blade member to move between a working position whereat said blade member is in said engagement with the surface of said positive electrode and a non-working position whereat said blade member is disengaged from said surface, releasable locking means releasably securing said first and second support members respectively to said first and second electrode-supporting members when said blade member is in said working position.

13. An apparatus as claimed in claim 3, wherein said blade member has a generally rectangular cross-section.

14. An apparatus as claimed in claim 13, wherein an elongated blade reinforcing member of rectangular cross-section partially extends in tight fit engagement into an elongated, longitudinally extending recess formed in said blade member, and wherein a portion of said blade reinforcing member projecting outwardly from said blade member is removably fixed to said blade-supporting member.

15. An apparatus as claimed in claim 14, wherein said blade member is made of a resilient, oil-resistant material.

16. An apparatus as claimed in claim 15, wherein said resilient, oil-resistant material is a synthetic rubber material.

17. An apparatus as claimed in claim 16, wherein said synthetic rubber material comprises a polyurethane.

18. An apparatus as claimed in claim 17, wherein said polyurethane has a Shore A hardness of about 25 to about 60.

19. An apparatus as claimed in claim 18, wherein said Shore A hardness is about 45.

20. An apparatus as claimed in claim 1, further including means for collecting the excess colloidal dispersion retained by said colloid arresting surface.

21. An apparatus as claimed in claim 20, wherein the longitudinal axis of said positive electrode extends horizontally and said excess colloidal dispersion overflows from the surface of said electrode at the ends thereof, and wherein said means for collecting said excess colloidal dispersion comprises a top-opened container disposed at each end of said electrode adjacent said blade member.

* * * * *